US008469754B1

(12) United States Patent
Maekawa et al.

(10) Patent No.: US 8,469,754 B1
(45) Date of Patent: Jun. 25, 2013

(54) OUTBOARD MOTOR

(75) Inventors: Shinya Maekawa, Shizuoka (JP); Koichi Nakayama, Shizuoka (JP); Toshio Suzuki, Shizuoka (JP); Katsumi Ochiai, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 271 days.

(21) Appl. No.: 13/081,532

(22) Filed: Apr. 7, 2011

(51) Int. Cl.
*B63H 21/32* (2006.01)

(52) U.S. Cl.
USPC ..... 440/89 H; 440/89 R

(58) Field of Classification Search
USPC ..... 440/89 B, 89 F, 89 H, 89 R
See application file for complete search history.

(56) References Cited

U.S. PATENT DOCUMENTS

| | | | | |
|---|---|---|---|---|
| 5,554,057 | A | 9/1996 | Abe et al. | |
| 5,556,311 | A * | 9/1996 | Fujimoto | 440/89 R |
| 5,911,610 | A * | 6/1999 | Fujimoto | 440/89 R |
| 7,698,889 | B1 | 4/2010 | Burk et al. | |
| 2009/0215341 | A1 | 8/2009 | Ochiai | |

OTHER PUBLICATIONS

Maekawa et al., "Marine Propulsion Device", U.S. Appl. No. 13/196,972, filed Aug. 3, 2011.
Nakayama et al., "Outboard Motor", U.S. Appl. No. 13/293,152, filed Nov. 10, 2011.
Maekawa et al., "Outboard Motor," U.S. Appl. No. 13/651,604, filed Oct. 15, 2012.

* cited by examiner

*Primary Examiner* — Lars A Olson
(74) *Attorney, Agent, or Firm* — Keating & Bennett, LLP

(57) ABSTRACT

An outboard motor includes an exhaust passage, a catalyst member, and a water capture member. The exhaust passage includes a first passage, a second passage, a third passage, and a fourth passage. The first passage is connected to exhaust ports, extends in a vertical direction, and collects exhaust discharged from the exhaust ports. The second passage extends laterally from the first passage. The third passage is connected to the second passage, extends downward from the second passage, and is disposed on a side of cylinders of an engine. The fourth passage is connected to the third passage, is positioned below the engine, and guides the exhaust to below the engine. The fourth passage discharges exhaust to the outside via a propeller boss of a propeller. The catalyst member is disposed in the third passage. The water capture member is disposed downstream of the catalyst member in the third passage.

9 Claims, 8 Drawing Sheets

OUTBOARD MOTOR

BACKGROUND OF THE INVENTION

1. Field of the Invention

The present invention relates to an outboard motor.

2. Description of the Related Art

Outboard motors provided with a catalyst to clean the exhaust from the engine are known. For example, in the outboard motor disclosed in U.S. Pat. No. 5,554,057, a catalyst is disposed below the engine. It is disclosed that water is kept out of the catalyst by disposing a heat accumulator downstream of the catalyst.

In U.S. Pat. No. 7,698,889, which relates to a stern drive rather than an outboard motor, it is disclosed that water is kept out of the catalyst by disposing a non-catalytic porous member downstream of the catalyst.

In the outboard motor disclosed in U.S. Patent Application Publication 2009/0215341, an exhaust pipe extends upward from a cylinder, passes above the cylinder, and extends downward at the opposite side of the cylinder. A moisture capture member is disposed in a portion of the exhaust pipe. The portion is positioned above the cylinder.

In the outboard motor of U.S. Pat. No. 5,554,057 referred to above, the catalyst and the heat accumulator are disposed in a position near the water surface. Because of this, the possibility of the catalyst and the heat accumulator becoming wet is high.

The motor disclosed in U.S. Pat. No. 7,698,889 is a stern drive that includes an engine disposed on-board, rather than an outboard motor. Because of this, an exhaust pipe extends above the engine. Consequently, the catalyst is disposed above the engine, and the moisture capture member is disposed even further above the engine and the catalyst. In cases in which this kind of structure is applied in outboardmotors, there is the possibility that if water passes through the moisture capture member, the water will reach all the way to the engine, and not merely the catalyst.

In the outboard motor of U.S. Patent Application Publication 2009/0215341, an exhaust pipe passes above a cylinder, and a moisture capture member is disposed in the section that has the highest position in the exhaust pipe. However, the top cover of the outboard motor houses the engine, and the space inside the top cover is therefore limited. Because of this, the layout of an exhaust pipe such as that of the outboard motor of U.S. Patent Application Publication 2009/0215341 is difficult to achieve without increasing the size of the outboard motor.

SUMMARY OF THE INVENTION

Preferred embodiments of the present invention provide an outboard motor that is compact and prevents wetting of the catalyst using a simple structure.

An outboard motor according to a preferred embodiment of the present invention includes an engine, a propeller, exhaust ports, an exhaust passage, a catalyst member, and a water capture member. The engine includes a plurality of cylinders aligned in a vertical direction. The propeller includes a propeller boss and is disposed below the engine. A plurality of exhaust ports is connected to each of the cylinders. The exhaust passage includes a first passage, a second passage, a third passage, and a fourth passage. The first passage is connected to the exhaust ports, extends in a vertical direction, and collects exhaust discharged from the exhaust ports. The second passage extends laterally from the first passage. The third passage is connected to the second passage, extends downward from the second passage, and is disposed on a side of the cylinders. The fourth passage is connected to the third passage, is positioned below the engine, guides the exhaust to below the engine, and discharges exhaust to the outside via the propeller boss. The catalyst member includes a catalyst and a catalyst carrier configured to support the catalyst and is disposed in the third passage. The water capture member is disposed downstream of the catalyst member in the third passage.

The outboard motor according to a preferred embodiment of the present invention does not have a piping structure such as one in which the exhaust passage passes above the engine. The piping structure is therefore simplified. This outboard motor can thereby be reduced in size. Also, because the water capture member is disposed downstream of the catalyst member, any droplets that may flow back inside the exhaust passage can be vaporized by the heat of the water capture member. Alternatively, the flow of droplets can be blocked by the resistance of the water capture member. The wetting of the catalyst member can therefore be prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
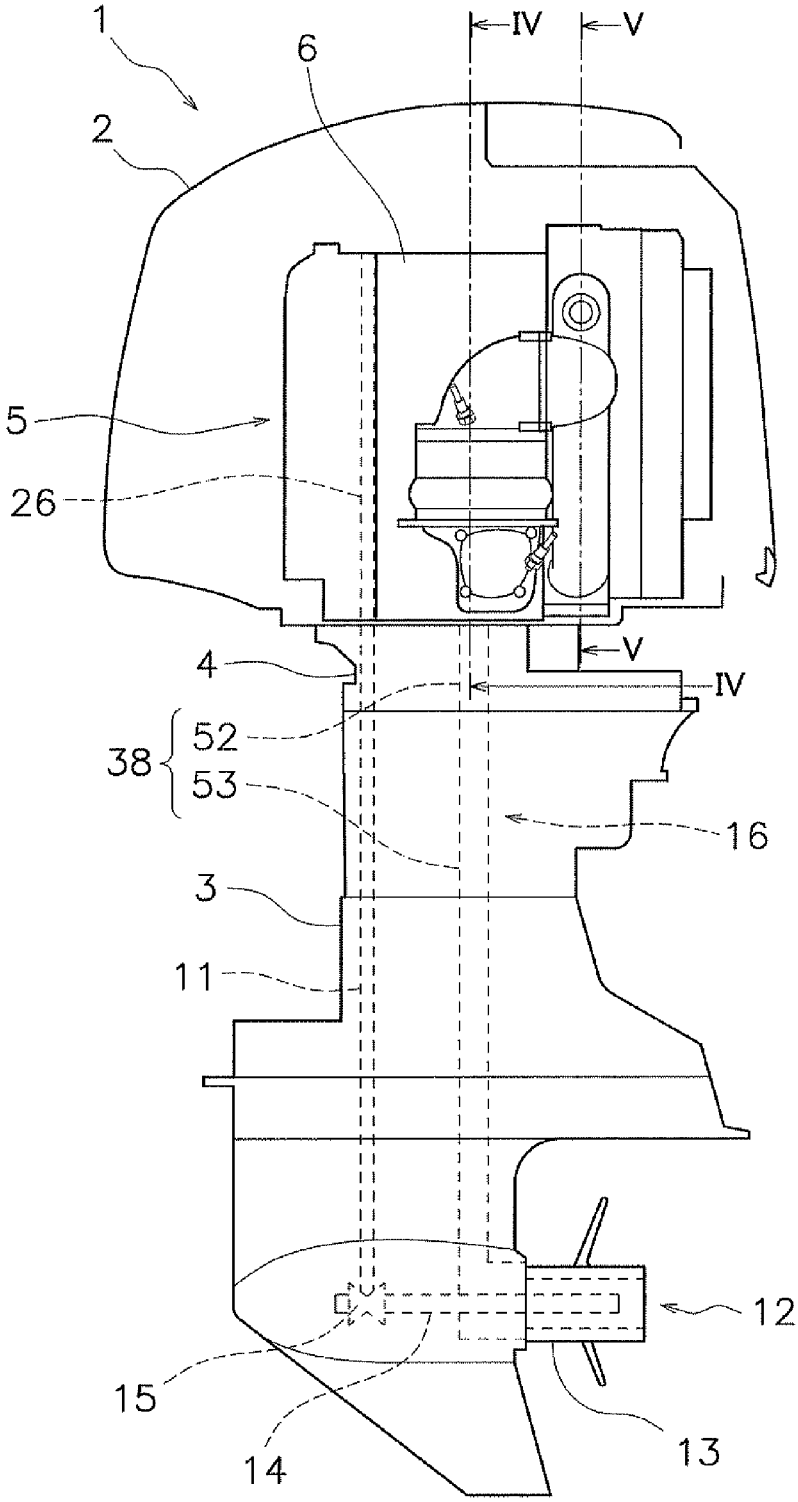
FIG. 1 is a side view of an outboard motor according to a preferred embodiment of the present invention.
Figure 2:
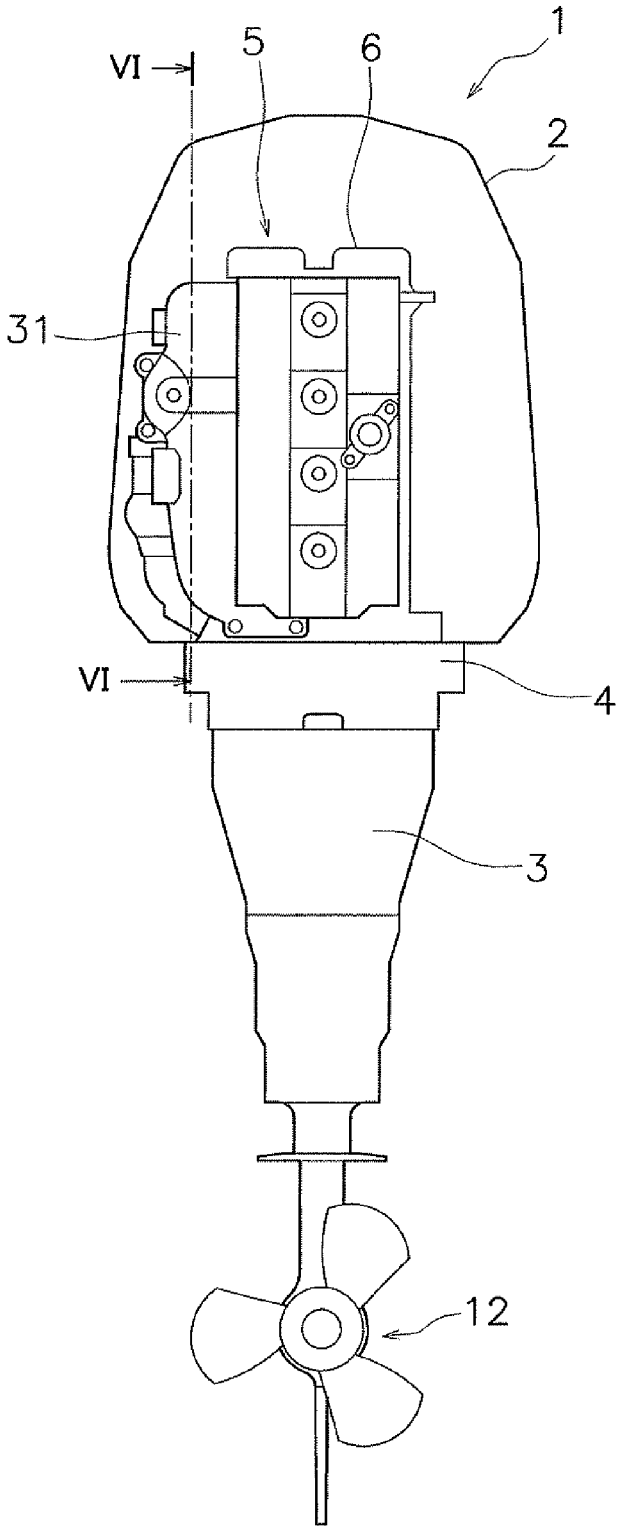
FIG. 2 is a rear view of an outboard motor according to a preferred embodiment of the present invention.

FIG. 1 is a side view showing an outboard motor 1 according to a preferred embodiment of the present invention. FIG. 2 is a rear view showing the outboard motor 1. As shown in FIGS. 1 and 2, the outboard motor 1 according to the present preferred embodiment includes an upper casing 2, a lower casing 3, an exhaust guide section 4, and an engine unit 5. For ease of understanding, the upper casing 2 is shown in cross section in FIGS. 1 and 2. The upper casing 2, the lower casing 3, and the engine unit 5 are fixed to the exhaust guide section 4.

The engine unit 5 is disposed inside the upper casing 2. A drive shaft 11 is disposed inside the lower casing 3, as shown in FIG. 1. The drive shaft 11 is disposed in the vertical direction inside the lower casing 3. The drive shaft 11 is fixed to a crankshaft 26 of an engine 6. A propeller 12 is disposed on the bottom portion of the lower casing 3. The propeller 12 is disposed below the engine 6. The propeller 12 includes a propeller boss 13. A propeller shaft 14 is disposed inside the propeller boss 13. The propeller shaft 14 is disposed in an anteroposterior direction, i.e., backward and forward direction. The propeller shaft 14 is linked to the bottom portion of the drive shaft 11 via a bevel gear 15.

In the outboard motor 1, the drive force generated by the engine 6 is transmitted to the propeller 12 via the drive shaft 11 and the propeller shaft 14. The propeller 12 is thereby rotated forward or in reverse. As a result, a propulsion force will be generated to cause the vessel equipped with the outboard motor 1 to move forward or backward.

The outboard motor 1 also includes an exhaust passage 16. The exhaust passage 16 is extends from the engine 6 through the exhaust guide section 4 and the lower casing 3 to the propeller boss 13 of the propeller 12. The exhaust discharged from the engine 6 is discharged into the water from the exhaust passage 16 through the propeller boss 13. The construction of the exhaust passage 16 will be described in detail later.

Figure 3:
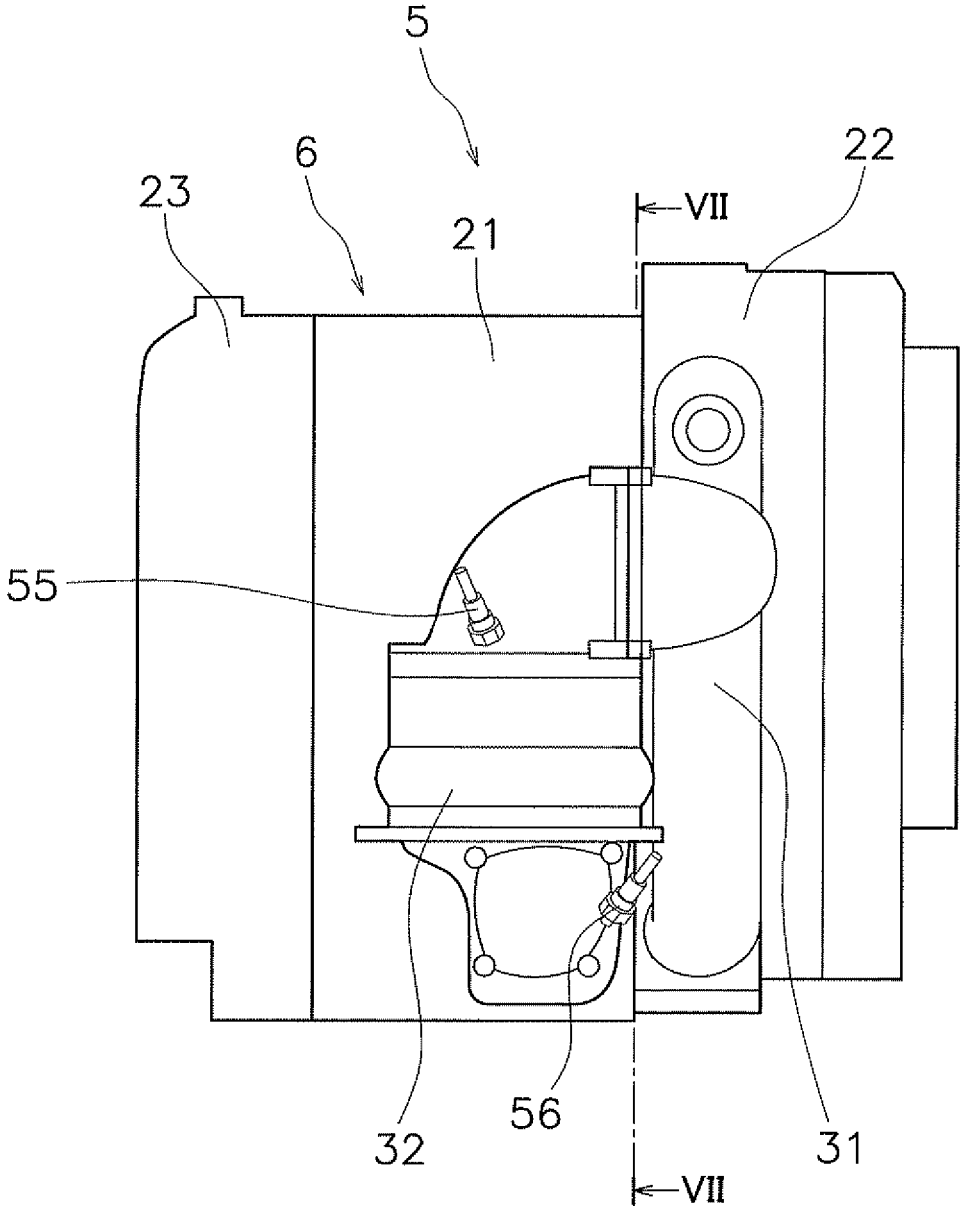
FIG. 3 is a side view of an engine unit according to a preferred embodiment of the present invention.

FIG. 3 is aside view of the engine unit 5. The engine unit 5 includes an engine 6, an exhaust manifold 31, and a catalyst unit 32, as shown in FIG. 3.

Figure 4:
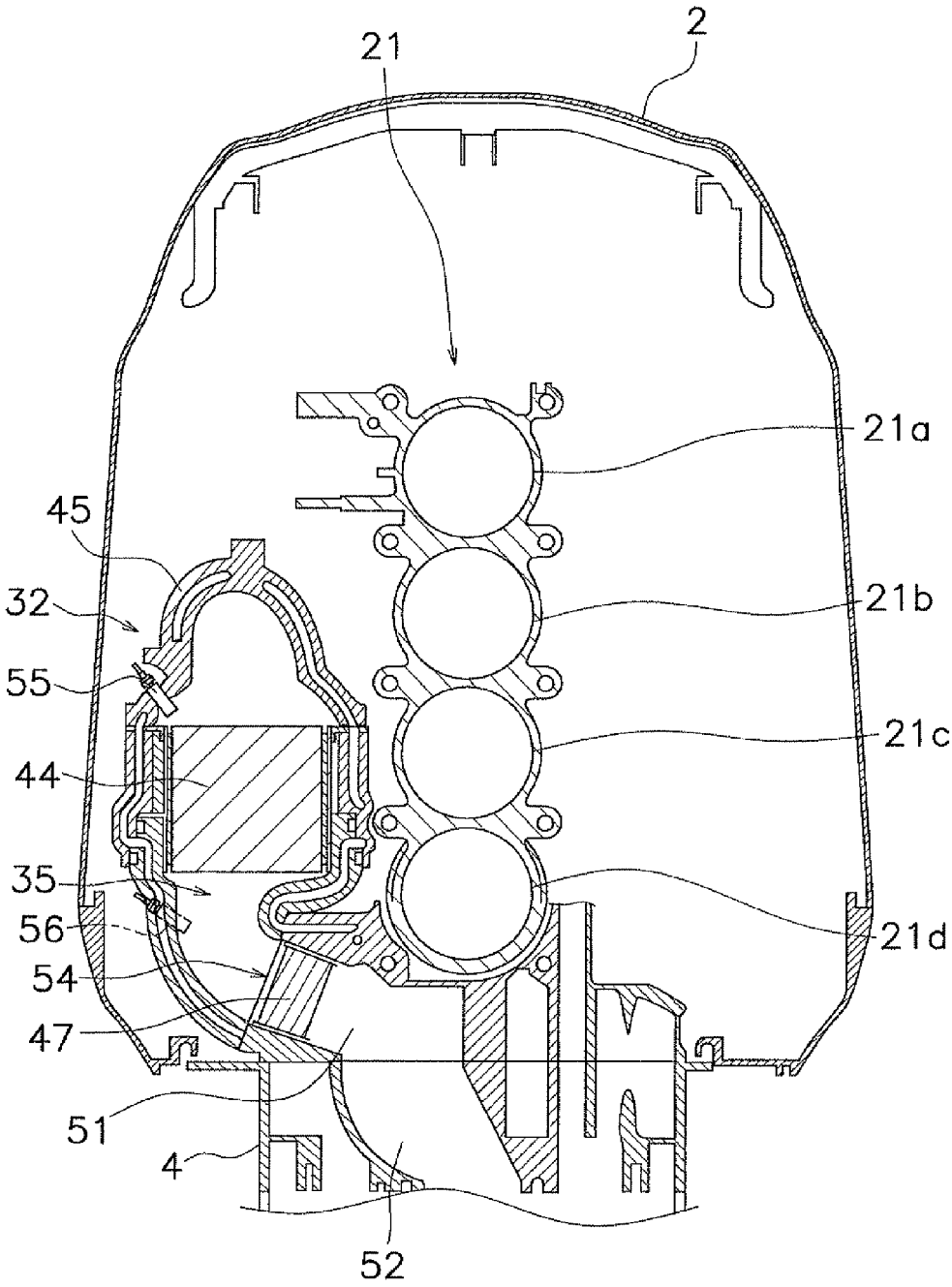
FIG. 4 is a cross-sectional view along line IV-IV in FIG. 1.

The engine 6 includes a cylinder block 21, a cylinder head 22, and a crankcase 23. The cylinder block 21 is disposed above the exhaust guide section 4 and fixed to the exhaust guide section 4. FIG. 4 is a cross-sectional view of IV-IV of the outboard motor 1 in FIG. 1. As shown in FIG. 4, the cylinder block 21 preferably includes four cylinders 21*a* to 21*d*. The four cylinders 21*a* to 21*d* are disposed in a line in a vertical direction.

Figure 5:
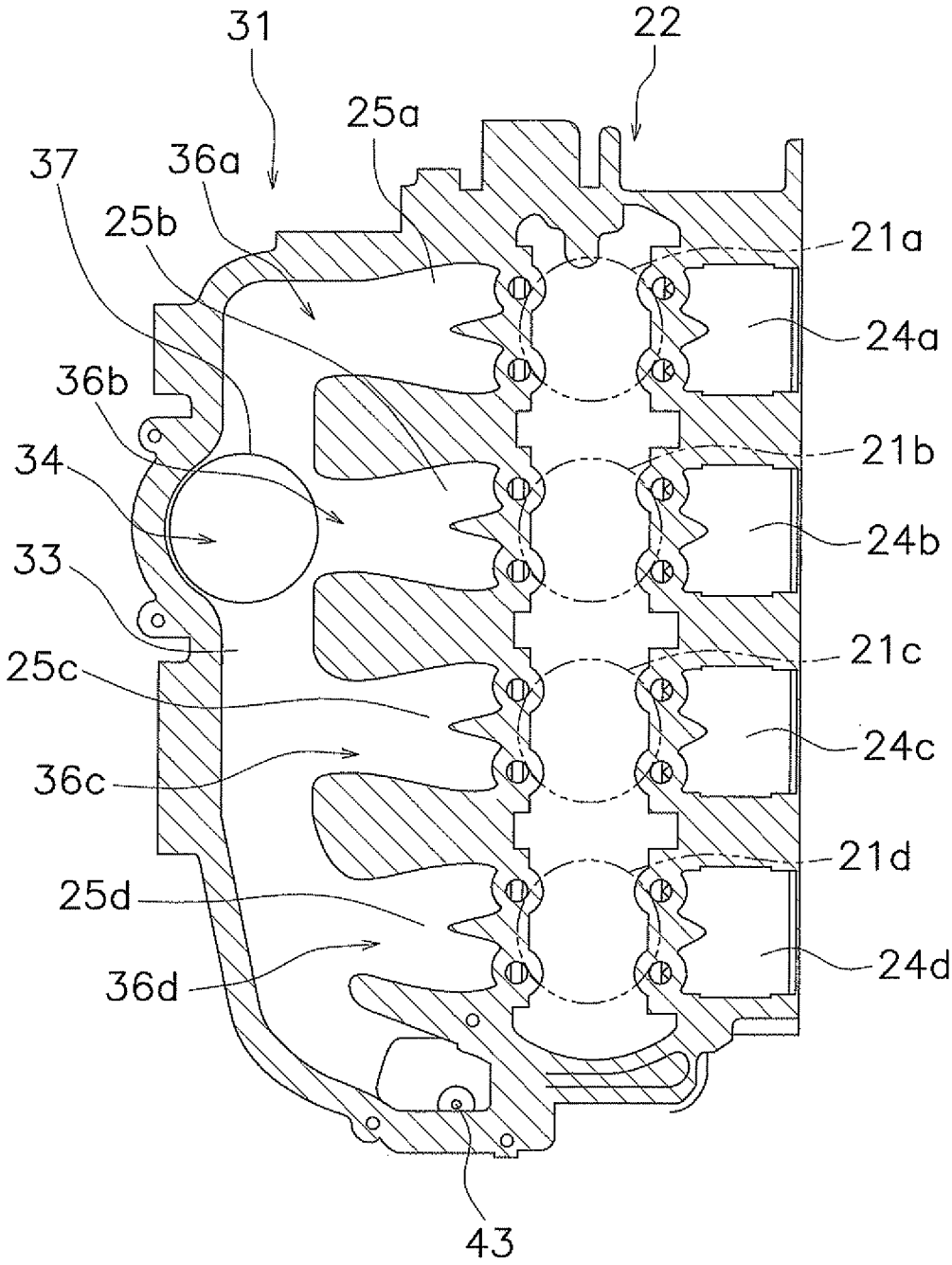
FIG. 5 is a cross-sectional view along line V-V in FIG. 1.

As shown in FIG. 3, the cylinder head 22 is disposed behind the cylinder block 21. FIG. 5 is across-sectional view of the outboard motor 1 along line V-V in FIG. 1. As shown in FIG. 5, intake ports 24*a* to 24*d* and exhaust ports 25*a* to 25*d* are disposed inside the cylinder head 22. The intake ports 24*a* to 24*d* and the exhaust ports 25*a* to 25*d* are connected to the cylinders 21*a* to 21*d*, respectively. The intake ports 24*a* to 24*d* are connected to a fuel supply system not shown in the drawing. The exhaust ports 25*a* to 25*d* extend in a lateral direction and are connected to a first passage 33 of an exhaust manifold 31, discussed below.

The crankcase 23 is disposed at the front of the cylinder block 21, as shown in FIG. 3. The crankshaft 26 (see FIG. 1) is disposed inside the crankcase 23. The crankshaft 26 extends in a vertical direction. The top end portion of the above-described driveshaft 11 is linked to the bottom end portion of the crankshaft 26. The movement of a piston (not shown) disposed inside the cylinders 21*a* to 21*d* is transmitted to the driveshaft 11 via the crankshaft 26.

The exhaust manifold 31 is disposed on the side of the cylinder head 22, as shown in FIG. 3. The exhaust manifold 31 is preferably integral with the cylinder head 22.

Figure 6:
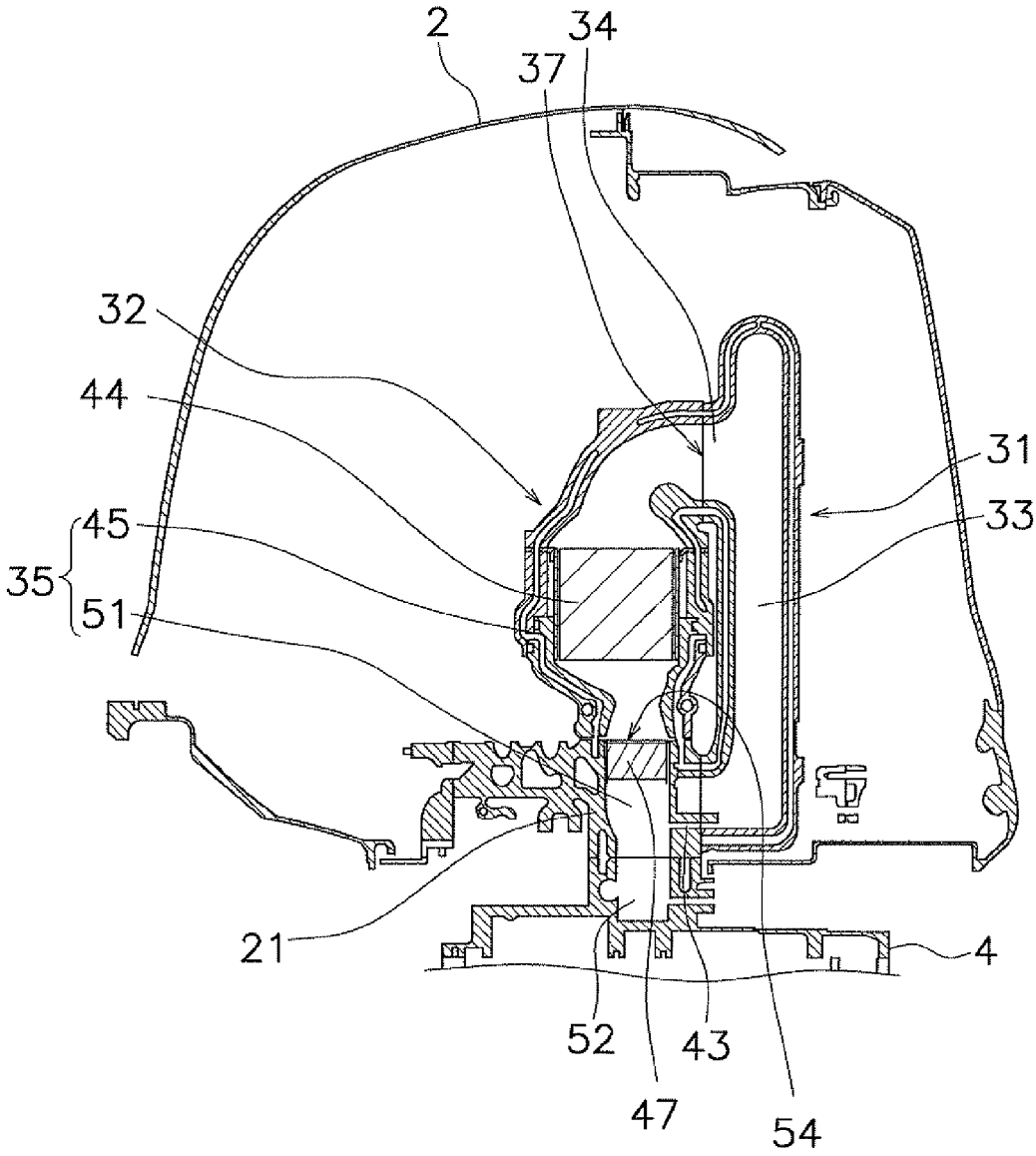
FIG. 6 is a cross-sectional view along line VI-VI in FIG. 2.
Figure 7:
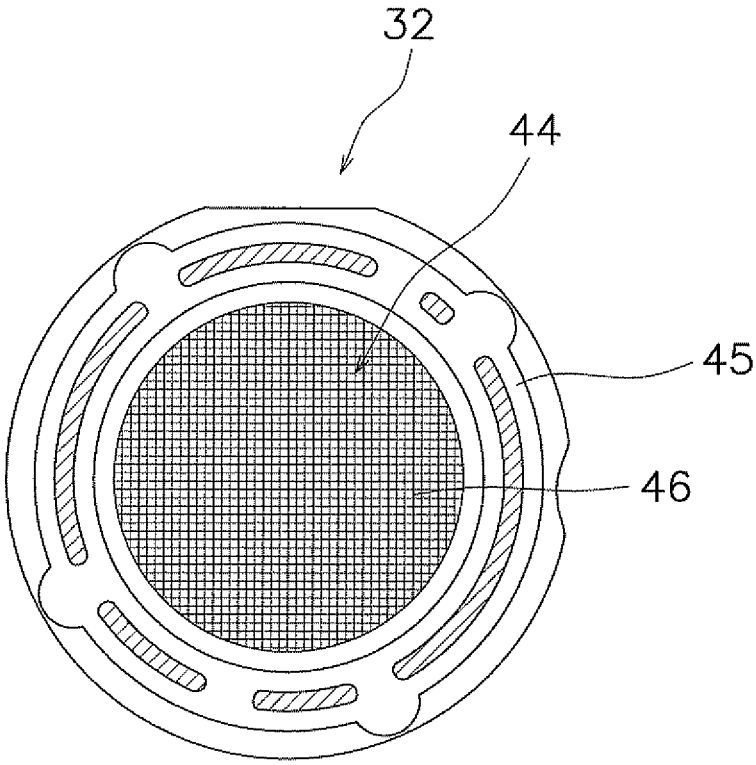
FIG. 7 is a cross-sectional view of the catalyst unit.

A catalyst unit 32 is preferably formed separately from the cylinder head 22 and the cylinder block 21. The catalyst unit 32 is also preferably separate from the exhaust manifold 31. The catalyst unit 32 is attached to the cylinder head 22 and the cylinder block 21. The catalyst unit 32 includes a catalyst member 44 and a pipe 45, as shown in FIGS. 4 and 6. The catalyst member 44 is disposed inside the pipe 45. The catalyst member 44 is positioned above the bottom end portion of the cylinder 21*d*, which is the lowest-positioned of the four cylinders 21*a* to 21*d*. The pipe 45 houses the catalyst member 44. The exhaust passing through the exhaust passage 16 passes through the catalyst member 44 inside the pipe 45, and is thereby cleaned. FIG. 7 is a cross-sectional view perpendicular to the axial direction of the catalyst unit 32. The catalyst member 44 includes a catalyst carrier 46, as shown in FIG. 7. The catalyst carrier 46 supports the exhaust-cleaning catalyst. A three-way catalyst, for example, can be used. The catalyst carrier 46 includes a cylindrical member having a honeycomb structure.

The exhaust passage 16, shown in FIG. 1, includes the first passage 33, a second passage 34, and a third passage 35, shown in FIG. 6, and a fourth passage 38, shown in FIG. 1. The first passage 33 and the second passage 34 are disposed inside the exhaust manifold 31, as shown in FIG. 6. The first passage 33 is connected to the above-described plurality of exhaust ports 25*a* to 25*d*. The first passage 33 is disposed on the side of the cylinder head 22 and extends in a vertical direction. A plurality of first openings 36*a* to 36*d* is formed in the first passage 33, as shown in FIG. 5, and each of the exhaust ports 25*a* to 25*d* is connected to the first passage 33 via each of the first openings 36*a* to 36*d*. The first passage 33 collects the exhaust discharged from the exhaust ports 25*a* to 25*d*.

The second passage 34 is connected to the first passage 33. As shown in FIG. 5, the portion connecting the second passage 34 and the first passage 33 is positioned between the top end of the cylinder 21*a* positioned at the uppermost portion of the plurality of cylinders 21*a* to 21*d*, and the bottom end of the cylinder 21*d* positioned at the lowermost portion of the plurality of cylinders 21*a* to 21*d*. Specifically, the vertical center portion of the portion connecting the second passage 34 and the first passage 33 is positioned higher than the vertical central portion of the first passage 33. More specifically, the portion connecting the second passage 34 and the first passage 33 is positioned at roughly the same height as the second highest cylinder 21*b* of the four cylinders 21*a* to 21*d*. The second passage 34 extends in an anteroposterior direction from the first passage 33. The second passage 34 is substantially parallel to the central axis line of the cylinders 21*a* to 21*d*. In other words, the second passage 34 extends in a roughly horizontal direction. The second passage 34 also includes a second opening 37. The catalyst unit 32 is connected to the second opening 37.

The third passage 35 includes the pipe 45 of the catalyst unit 32 and a first lower passage 51, as shown in FIG. 6. The third passage 35 is connected to the second passage 34. The third passage 35 extends downward from the second passage 34. Therefore, the third passage 35 is disposed substantially parallel to the crankshaft 26 (see FIG. 1). The third passage 35 is disposed on the side of the cylinder block 21. The first lower passage 51 is disposed inside the cylinder block 21. The first lower passage 51 includes a first lower opening 54. The first lower opening 54 is located on the lower portion of the lateral face of the cylinder block 21. The first lower passage 51 is connected to the catalyst unit 32 via the first lower opening 54. A water capture member 47 is disposed downstream of the catalyst member 44 inside the third passage 35. Specifically, the water capture member 47 is disposed in the first lower passage 51, and is positioned below the catalyst member 44. The water capture member 47 includes a cylindrical member having the same honeycomb structure as the catalyst carrier 46 of the catalyst unit 32. The water capture member 47 may be made from a metal honeycomb or ceramic honeycomb, for example. Also, the water capture member 47 may or may not support a catalyst. The water capture member 47 has a smaller outside diameter than does the catalyst carrier 46 of the catalyst unit 32.

The fourth passage 38, as shown in FIG. 1, guides the exhaust from the exhaust ports 25*a* to 25*d* below the engine 6 and discharges the exhaust to the outside via the propeller boss 13. The fourth passage 38 is positioned below the engine 6. The fourth passage 38 includes a second lower passage 52 and a third lower passage 53. The second lower passage 52 is disposed inside the exhaust guide section 4. The second lower passage 52 is connected to the first lower passage 51, as shown in FIGS. 4 and 6. The third lower passage 53 is disposed inside the lower casing 3, as shown in FIG. 1. The third lower passage 53 is connected to the second lower passage 52. The third lower passage 53 is also connected to the propeller boss 13.

In the outboard motor 1 according to the present preferred embodiment, the exhaust from the exhaust ports 25*a* to 25*d* of the engine 6 is collected in the first passage 33. The exhaust flows from the first passage 33 through the second passage 34 to the third passage 35. The exhaust is cleaned by being passed through the catalyst member 44 in the third passage 35. The exhaust flows from the third passage 35 to the fourth passage 38. The exhaust is sent downward from the engine 6 by being passed through the fourth passage 38. Then, the exhaust passes through the inside of the propeller boss 13 from the fourth passage 38 and is discharged outside.

A linking passage 43 is connected to the bottom end portion of the first passage 33, as shown in FIGS. 5 and 6. The linking passage 43 passes through a wall section of the cylinder block 21 and is linked to the first lower passage 51, discussed below. Therefore, the linking passage 43 links the bottom end portion of the first passage 33 and the first lower passage 51. More specifically, the linking passage 43 links a portion of the first lower passage 51 positioned downstream of the water capture member 47 and the bottom end portion of the first passage 33. The linking passage 43 has a smaller cross-sectional area than the cross-sectional area of the second opening 37. Because of this, the exhaust discharged from the linking passage 43 is negligible in comparison with the second opening 37. By contrast, the condensed water generated inside the first passage 33 flows to the first lower passage 51 via the linking passage 43. Then, the condensed water passes through the fourth passage 38 and is discharged outside via the propeller boss 13. The linking passage 43 thus functions as a condensed water removal passage whereby the condensed water generated inside the first passage 33 is removed from the first passage 33.

The catalyst unit 32 also includes a first oxygen sensor 55 and a second oxygen sensor 56 arranged to detect an oxygen concentration in the exhaust, as shown in FIGS. 3 and 4. The first oxygen sensor 55 is disposed upstream of the catalyst member 44 in the exhaust passage 16. Specifically, the first oxygen sensor 55 is disposed above the catalyst member 44 in the pipe 45. The second oxygen sensor 56 is disposed below the catalyst member 44 in the pipe 45. The second oxygen sensor 56 is disposed downstream of the catalyst member 44 in the exhaust passage 16. Specifically, the second oxygen sensor 56 is disposed between the catalyst member 44 and the water capture member 47 in the exhaust passage 16. That is, the water capture member 47 is disposed between the second oxygen sensor 56 and the linking passage 43 in the exhaust passage 16. A detection signal from the first oxygen sensor 55 and the second oxygen sensor 56 is supplied to an ECU (not shown). The ECU controls the engine 6 on the basis of the detection value from the first oxygen sensor 55 and the second oxygen sensor 56.

In the outboard motor 1, the exhaust passage 16 does not have a piping structure such as the one that passes above the engine 6. Because of this, the piping structure is simplified. The outboard motor 1 can thereby be reduced in size.

Because the water capture member 47 is disposed downstream of the catalyst member 44 and the second oxygen sensor 56, any droplets can be vaporized by the heat of the water capture member 47 even if, for example, the droplets were to flow back into the exhaust passage. Alternatively, because the water capture member 47 is disposed below the catalyst member 44 and the second oxygen sensor 56, the flow of droplets can be prevented by the resistance of the water capture member 47. Because of this, the inflow of droplets to the catalyst member 44 and the second oxygen sensor 56 can be prevented. The deterioration of the catalyst member 44 can thereby be prevented. Also, the reliability of the second oxygen sensor 56 can be improved.

The water capture member 47 is disposed in the first lower passage 51, making it possible for the catalyst unit 32 to be reduced in size in comparison with the case in which the water capture member 47 is disposed in the catalyst unit 32.

A preferred embodiment of the present invention was described above, but the present invention is not limited to the above-described preferred embodiment and can be modified in a variety of ways within a range that does not depart from the scope of the invention.

The number of the cylinders is not limited to four. The number of the cylinders may also be three or less. Alternatively, the number of the cylinders may be five or greater.

The exhaust manifold 31 may be a component that is separate from the cylinder head 22. Also, the first passage 33 and the second passage 34 included in the exhaust manifold 31 may be constructed from separate components. The third passage 35 may be constructed solely from the pipe 45 of the catalyst unit 32 without including the above-described first lower passage 51. Alternatively, the third passage 35 may be further constructed from a separate member in addition to the catalyst unit 32 and the first lower passage 51.

The water capture member 47 is not limited to the catalyst carrier and may be any member that has high permeability to gases but low permeability to liquids. A member in the form of perforated metal and/or a mesh, for example, may also be used as the water capture member 47, for example.

Figure 8:
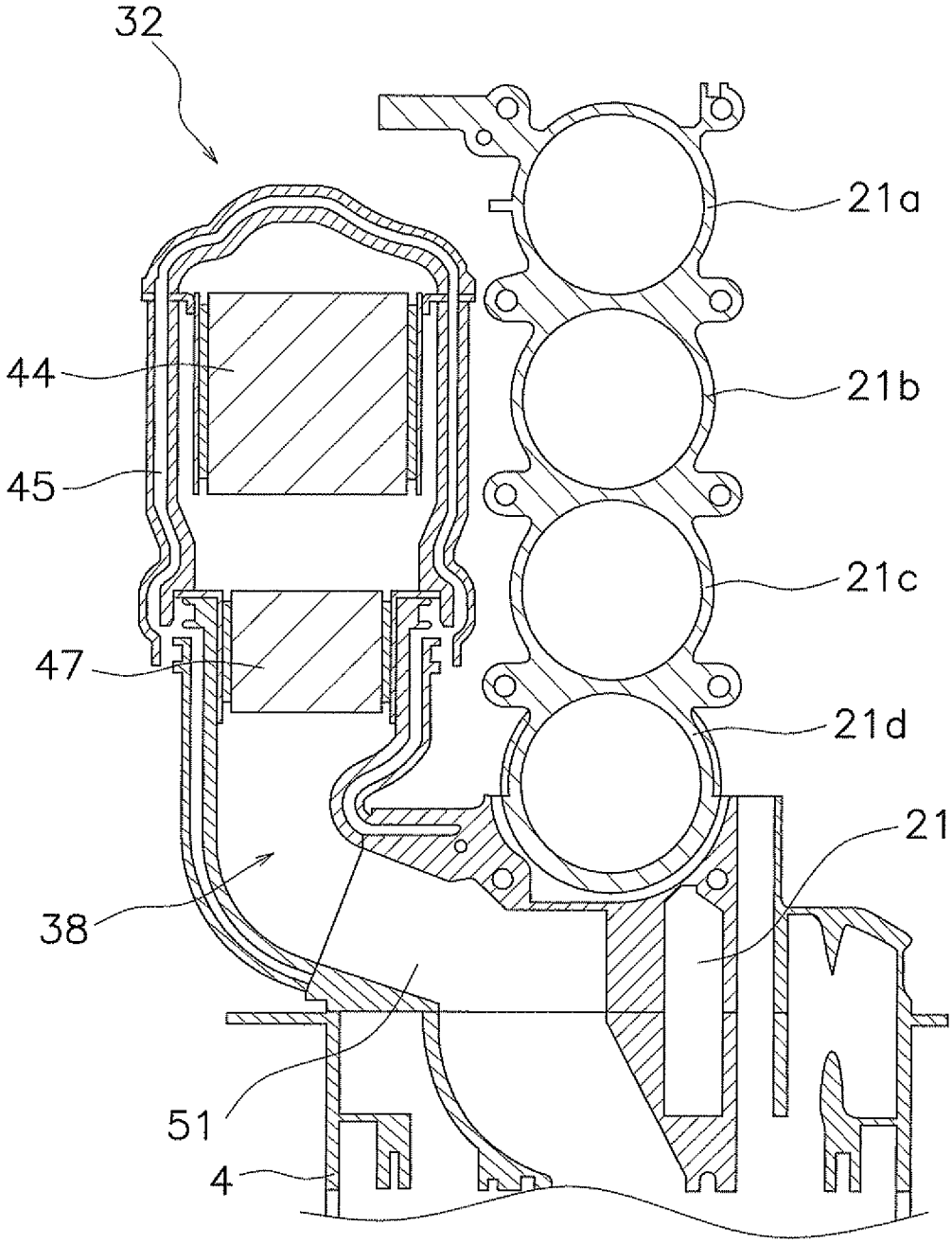
FIG. 8 is a cross-sectional view showing a construction of an exhaust passage of an outboard motor according to another preferred embodiment of the present invention.

The water capture member 47 may be disposed in the pipe 45 of the catalyst unit 32, rather than in the first lower passage 51, as shown in FIG. 8. Specifically, the water capture member 47 may be disposed downstream of the catalyst member 44 in the pipe 45. In this case, the water capture member 47 can be disposed in a higher position compared with a case in which the water capture member 47 is disposed in the first lower passage 51. The possibility of the catalyst member 44 and the second oxygen sensor 56 becoming wet can thereby be reduced. Because the outside diameter of the water capture member 47 can easily be enlarged, the pressure loss inside the water capture member 47 can also be reduced.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine including a plurality of cylinders aligned in a vertical direction;

a propeller including a propeller boss, the propeller being disposed below the engine;

a plurality of exhaust ports connected to each of the plurality of cylinders; and an exhaust passage including:

a first passage that is connected to the exhaust ports, extends in a vertical direction, and collects exhaust discharged from the exhaust ports;

a second passage that extends laterally from the first passage;

a third passage that is connected to the second passage, extends downward from the second passage, and is disposed on a side of the cylinders; and a fourth passage that is connected to the third passage, is positioned below the engine, guides the exhaust to below the engine, and discharges the exhaust to outside the outboard motor via the propeller boss;

a catalyst member disposed in the third passage and including a catalyst and a catalyst carrier configured to support the catalyst; and a water capture member disposed downstream of the catalyst member in the third passage.

2. The outboard motor according to claim 1, wherein a portion connecting the second passage and the first passage is positioned between a top end of a cylinder positioned at an uppermost portion of the plurality of cylinders and a bottom end of a cylinder positioned at a lowermost portion of the plurality of cylinders.

3. The outboard motor according to claim 1, wherein the second passage is substantially parallel to a central axis line of the plurality of cylinders.

4. The outboard motor according to claim 1, wherein the water capture member is disposed below the catalyst member.

5. The outboard motor according to claim 1, wherein the water capture member includes a cylindrical member including a honeycomb structure;

the catalyst carrier includes a cylindrical member including a honeycomb structure; and the water capture member has a smaller outside diameter than an outside diameter of the catalyst carrier.

6. The outboard motor according to claim 1, wherein the water capture member includes a non-catalytic honeycomb structure.

7. The outboard motor according to claim 1, further comprising an oxygen sensor arranged to detect an oxygen concentration in the exhaust and disposed upstream of the catalyst member in the exhaust passage.

8. The outboard motor according to claim 1, further comprising an oxygen sensor arranged to detect an oxygen concentration in the exhaust and disposed between the catalyst member and the water capture member in the exhaust passage.

9. The outboard motor according to claim 1, further comprising a condensed water-removal passage arranged to connect a lower end portion of the first passage and a portion in the exhaust passage positioned downstream of the water capture member.

* * * * *